US006506294B1

(12) United States Patent
Starcevic et al.

(10) Patent No.: US 6,506,294 B1
(45) Date of Patent: Jan. 14, 2003

(54) PROCESS FOR REGENERATION OF ELECTROLYTES FROM PICKLE LIQUOR, IN PARTICULAR OF $NA_2S0_4$ FROM PICKLE LIQUOR FOR STAINLESS STEEL

(75) Inventors: Jovan Starcevic, Rossackgasse; Edgar Braun, Khekgasse, both of (AT)

(73) Assignee: Andritz-Patentverwaltungs-Gesselschaft m.b.H., Graz (AT)

( * ) Notice: Subject to any disclaimer, the term of this patent is extended or adjusted under 35 U.S.C. 154(b) by 0 days.

(21) Appl. No.: 08/601,675

(22) Filed: Feb. 15, 1996

(30) Foreign Application Priority Data

Feb. 15, 1995 (AT) ..... 268/95

(51) Int. Cl.[7] ..... B01D 17/06

(52) U.S. Cl. ..... 205/705; 205/712; 205/717; 205/741

(58) Field of Search ..... 205/705, 712, 205/717, 741

(56) References Cited

FOREIGN PATENT DOCUMENTS

JP 01-184096 * 7/1989

OTHER PUBLICATIONS

Petkevich et al. "Removal of chromates" from the wastewaters of electroplating factories. (1987) Abstract only Urbas "Removal of hexa– and trialent chromium from wastewaters" (1979) Abstract only.*

* cited by examiner

*Primary Examiner*—Arun S. Phasge
(74) *Attorney, Agent, or Firm*—Alix, Yale & Ristas, LLP

(57) ABSTRACT

A process for regeneration of electrolytes, in particular $Na_2SO_4$, from waste pickles created during picking of stainless steel, in particular stainless steel strips. The electrolytes are regenerated by adding $Na_xH_yS_zO_v$ in an acid solution whereby $Cr^{6+}$ is reduced to $Cr^{3+}$. Variables x, y, z and v having the following values: x=0 to 2, y=0 to 2, z=1 to 6, v=2 to 6.

4 Claims, 1 Drawing Sheet

PROCESS FOR REGENERATION OF ELECTROLYTES FROM PICKLE LIQUOR, IN PARTICULAR OF $NA_2S0_4$ FROM PICKLE LIQUOR FOR STAINLESS STEEL

BACKGROUND OF THE INVENTION

The invention concerns a process for regeneration of electrolytes, in particular of $Na_2SO_4$ from spent pickling liquid, or pickle liquors, for stainless steel, in particular, stainless steel strips.

The "neolyte" process using a neutral electrolyte has become widely accepted all over the world for electrolytically pickling stainless steel strip, in particular cold strip. This process provides for the strip to be de-scaled in a sodium sulphate solution by means of electric current. In the process, metals build up in the electrolyte—i.e., the sodium sulphate solution in this case. Chromium is dissolved in the form of chromate ($Cr^{6+}$), while the other metals such as iron and nickel are present in the form of hydroxides.

The metal content of the pickling acid is kept constant by continuous extraction of electrolyte from the pickling bath and its substitution with fresh sodium sulphate solution. This causes considerable operating expenses for sodium sulphate and for the disposal of the spent electrolyte solution.

SUMMARY OF THE INVENTION

Briefly stated, the invention in a preferred form is a process for regenerating the electrolyte present in the pickle liquors which reduces both the operating cost and the environmental impact of so-called neolyte pickling plants.

In the process according to the invention, this objective is achieved by adding $Na_xH_yS_zO_v$ in an acid solution, which causes $Cr^{6+}$ to be reduced to $Cr^{3+}$, with the suffixes being x=0 to 2, y=0 to 2, z=1 to 6, v=2 to 6. By adding this substance, $Na_2SO_4$ is produced in any of the reactions and can be easily recycled to the process.

An advantageous design of the invention is characterized by the fact that no foreign atoms are introduced to the solution. This avoids formation of other, undesirable reaction products apart from $Na_2SO_4$.

An advancement of the invention is characterized by the fact that the reaction takes place at a pH in the range of approx. 2–3. The decrease of the pH is favorably effected with $H_2SO_4$, which also means that no foreign atoms are introduced to the solution. Having the reduction take place in the acid range speeds up the reaction in an advantageous manner.

An advantageous design of the invention is characterized by the fact that the acid solution produced is neutralized by adding NaOH. This neutralization with NaOH causes $Na_2SO_4$, which can be easily recycled to the process, to be formed also in this step.

An advantageous advancement of the invention is characterized by the fact that the metal hydroxides produced by neutralization are separated from the pickling acid ($Na_2SO_4$) and the solution is recycled to the pickling process. By recycling the pickling acid, the high cost of fresh pickling acid is avoided, and by separation of the metal hydroxides from the pickling acid these can be deposited at a higher concentration, i.e., with a lower content of residual acid.

BRIEF DESCRIPTION OF THE DRAWING

The present invention may be better understood and its numerous objects and advantages will become apparent to those skilled in the art by reference to the accompanying drawing in which.

DETAILED DESCRIPTION OF THE PREFERRED EMBODIMENT

Figure 1:
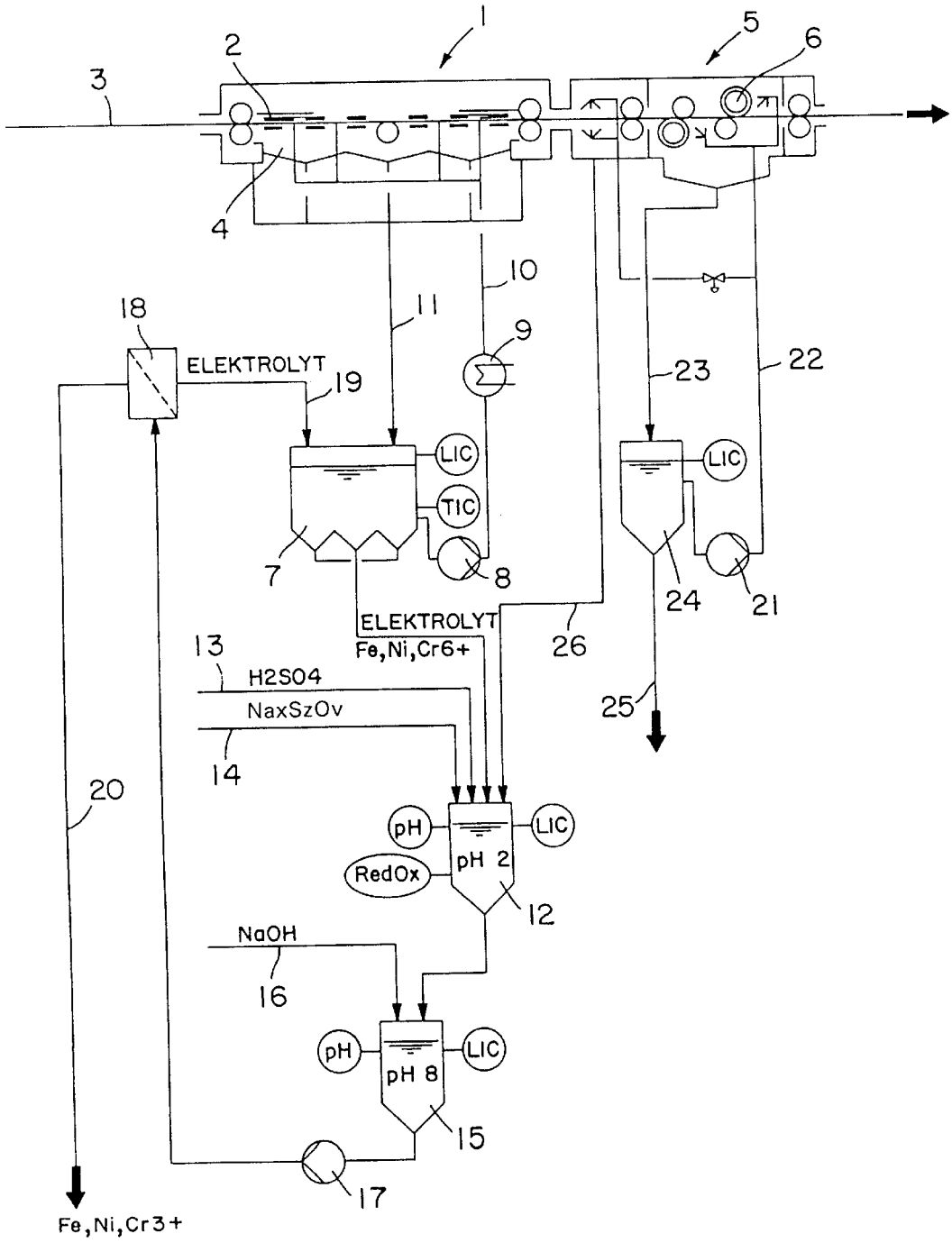
FIG. 1 is a schematic diagram of a pickling system with neolyte recovery in accordance with the invention.

FIG. 1 shows an electrolytic pickling system 1 with electrode pairs 2, through which a metal strip 3 is routed, and more particularly through section 4 which is filled with pickling acid. As pickling acid, a neutral electrolyte like $Na_2SO_4$ is used. The pickling system is followed by a cleaning system 5, which contains cleaning brushes 6.

The neutral electrolyte is introduced to the pickling plant 1 from the circulation tank 7 of the pickling plant 1 and via a pump 8 that is advantageously adjustable, a heat exchanger 9 whose temperature can be adjusted and a pipe 10. This can be done as required, preferably at several points. The waste pickle acid, or pickle liquor, enriched with the scale from the metal strip 3 as well as a large portion of $Cr^{6+}$ ions, apart from iron and nickel, is piped to the circulation tank 7 via a pipe 11. The electrolyte enriched with metal ions is piped to the circulation tank 7 and further on to a reaction tank 12. In one embodiment, fresh sulfuric acid ($H_2SO_4$) is added via a pipe 13 to decrease the pH, and a reduction agent such as $Na_2S_2O_5$ for reducing $Cr^{6+}$ is added via pipe 14. The pH in the reaction tank 12 is in the acid range, and is, for instance, pH=2. As a result of the reaction, $Na_2SO_4$ is produced in accordance with the following representative formulae.

$$3\ Na_2SO_3+3\ H_2SO_4+2\ H_2CrO_4 \rightarrow Cr_2(SO_4)_3+3\ Na_2SO_4+5\ H_2O \quad 1)$$

$$6\ Na_2S_2O_3+6\ H_2SO_4+2\ H_2CrO_4 \rightarrow Cr_2(SO_4)_3+3\ Na_2SO_4+3\ Na_2S_4O_6+8\ H_2O \quad 2)$$

$$3\ Na_2S_2O_5+3\ H_2O \Longleftrightarrow 6\ NaHSO_3\ 6\ NaHSO_3+2\ H_2CrO_4 \rightarrow Cr_2(SO_3)_3+3\ Na_2SO_4+5\ H_2O \quad 3)$$

leads to $$3\ Na_2S_2O_5+2\ H_2CrO_4 \rightarrow Cr_2(SO_3)_3+3\ Na_2SO_43+2\ H_2O$$

$$3\ Na_2S_2O_4+3\ H_2SO_4+4\ H_2CrO_4 \rightarrow Cr_2(SO_4)_3+Cr_2(SO_3)_3+3\ Na_2SO_4+7\ H_2O \quad 4)$$

$$3\ Na_2S_2O_6+2\ H_2CrO_4 \rightarrow Cr_2(SO_4)_3+3\ Na_2SO_4+2\ H_2O \quad 5)$$

The above formulae show possible reactions in an exemplary manner, with $Cr^{6+}$ being reduced to $Cr^{3+}$ and $Na_2SO_4$ being formed again as neutral electrolyte.

Preferably, the acid and reduction agent that are added to the waste pickle acid contain only chemical elements that are already present in the waste pickle acid. That is, the acid and reduction agent contain no foreign chemical elements (chemical elements that are foreign to the waste pickle acid). This ensures that the chemical reaction produces $Na_2SO_4$ and prevents formation of other, undesirable reaction products.

The reaction products such as iron and nickel hydroxide are routed to a neutralization stage 15. For neutralization, NaOH is added via a pipe 16. The pH in the neutralization tank 15 is in the neutral range, i.e., pH=8–9. The sludge (the mother liquor) in neutralization stage 15 is then pumped to a filter 18 via a pump 17, and from there, the electrolyte, i.e., the pure $Na_2SO_4$ solution, is led to circulation tank 7 via pipe 19 and thus recycled to the process. The phase enriched with metal oxides is extracted from filter 18 via pipe 20 as sludge, and can then be deposited.

In the following example, the process according to the invention is compared to the hitherto known neolyte process. Cold strip sized 1250 mm×0.8 mm and made of quality AISI 304 steel was pickled at a strip speed of 85 m/min. The average pickling loss amounted to 3 g/m$^2$. The $Na_2SO_4$ concentration was 150 g/l and the $Cr^{6+}$ concentration 5 g/l.

This yielded the following quantities:

| | Neolyte process with $Cr^{6+}$ reduction | Process as per the invention with recovery of neolyte | Difference between the invention and state of the art | Unit |
|---|---|---|---|---|
| $Na_2SO_4$ | 206.6 | 23.5 | −183.1 | kg/h |
| $H_2SO_4$ | 33.9 | 35.4 | 1.5 | kg/h |
| $Na_2S_2O_5$ | 18.7 | 18.9 | 0.2 | kg/h |
| NaOH | 0.0 | 36.1 | 36.1 | kg/h |
| Water for neolyte | 1775.6 | 321.3 | −1454.3 | l/h |
| Rinse water | 1500.0 | 1500.0 | 0.0 | l/h |
| Waste pickle to neutralization | 1458.4 | 792.7 | −665.7 | l/h |
| pH of sludge | pH = 2 | pH = 8 | | |

The above chart shows that the consumption of $Na_2SO_4$ for the pickle was substantially reduced. Also, the consumption of water was reduced correspondingly. The waste sludge amount was about halved, with the pH now being in the neutral range. The savings of lime for neutralization were not taken into account in the above overview.

Rinsing water is added in the cleaning stage 5 which follows the pickling plant 1 by a pump 21 and a pipe 22 and sprayed onto the strip 3 for instance at the entrance of the metal strip 3 into the cleaning stage 5 or near the brush rolls 6. The sludge is routed to a settling tank 24 via a pipe 23 and then extracted from there through a pipe 25 and deposited. Wash water is led to the reaction tank 12 via pipe 26.

The invention is not limited to the design shown in FIG. 1, it may well be laid out without a cleaning system or with a cleaning system designed in a different manner. Also, several pickling systems may be arranged one after the other.

What is claimed is:

1. Process for regenerating neutral electrolytes from waste pickles created by a pickling process for stainless steel, the waste pickles containing $Cr^{6+}$, the process comprising the steps of:

introducing an acid solution comprising $Na_xH_yS_zO_v$ to the waste pickle to form a reaction solution, the variables being x=0 to 2, y=0 to 2, z=1 to 6 and v=2 to 6, wherein the $Cr^{6+}$ is reduced to $Cr^{3+}$;

further adding NaOH to the reaction solution to neutralize the reaction solution and produce metal hydroxides; and further separating the metal hydroxides from the electrolyte to produce the acid solution and returning the acid solution to the pickling process.

2. Process according to claim 1, wherein the introduced acid solution does not contain any foreign chemical elements.

3. Process according to claim 2 further comprising the steps of reducing the pH of the waste pickle and maintaining the pH of the reaction solution in the range of 2 to 3 during the reaction of the waste pickle and the acid solution.

4. Process according to claim 1 further comprising the steps of reducing the pH of the waste pickle and maintaining the pH of the reaction solution in the range of 2 to 3 during the reaction of the waste pickle and the acid solution.

* * * * *

UNITED STATES PATENT AND TRADEMARK OFFICE

CERTIFICATE OF CORRECTION

PATENT NO. : 6,506,294 B1
APPLICATION NO. : 08/601675
DATED : January 14, 2003
INVENTOR(S) : Starcevic et al.

It is certified that error appears in the above-identified patent and that said Letters Patent is hereby corrected as shown below:

In Item (*), Notice, on Title page, delete "0 days" and replace with --949 days--.

Signed and Sealed this

Fourth Day of July, 2006

JON W. DUDAS
*Director of the United States Patent and Trademark Office*